US008246414B2

(12) United States Patent
Suzuki

(10) Patent No.: US 8,246,414 B2
(45) Date of Patent: Aug. 21, 2012

(54) AIR SHIFTER TOY MODEL

(75) Inventor: Masaki Suzuki, Yamagata (JP)

(73) Assignee: Top Notch Toys Ltd. Co., Harbour, Tst, Kowloon (HK)

( * ) Notice: Subject to any disclaimer, the term of this patent is extended or adjusted under 35 U.S.C. 154(b) by 176 days.

(21) Appl. No.: 12/820,294

(22) Filed: Jun. 22, 2010

(65) Prior Publication Data

US 2010/0330866 A1 Dec. 30, 2010

Related U.S. Application Data

(60) Provisional application No. 61/220,228, filed on Jun. 25, 2009.

(51) Int. Cl.
*A63H 27/18* (2006.01)
*A63H 27/30* (2006.01)

(52) U.S. Cl. ..... 446/68; 446/454; 446/66

(58) Field of Classification Search ..... 446/33–38, 446/57, 58, 61, 68, 454, 456, 457, 458; 244/53 R, 244/62

See application file for complete search history.

(56) References Cited

U.S. PATENT DOCUMENTS

| | | | | |
|---|---|---|---|---|
| 3,839,818 | A * | 10/1974 | Heggedal | 446/62 |
| 3,995,393 | A * | 12/1976 | Patterson | 446/66 |
| 5,383,805 | A * | 1/1995 | Tsai | 446/66 |
| 6,405,903 | B2 * | 6/2002 | Stadelhofer | 222/309 |
| 6,612,893 | B2 * | 9/2003 | Rehkemper et al. | 446/34 |
| 7,883,392 | B2 * | 2/2011 | Van de Rostyne et al. | 446/36 |
| 7,946,526 | B2 * | 5/2011 | Zimet | 244/17.19 |

* cited by examiner

*Primary Examiner* — Kien Nguyen
(74) *Attorney, Agent, or Firm* — Tutunjian & Bitetto, P.C.

(57) ABSTRACT

The present invention provides an unconventional and proprietary radio control (RC) or infrared remote control (IR) toy model/airplane which can intentionally shift or change its center of gravity (COG) to different positions along the longitudinal centerline of the aircraft or fuselage. The incremental shifting or moving of the COG from front to rear or vice versa incrementally changes the "angle of attack" of the wing, thereby producing a variable range of viable flight attitudes and resultant terminal velocities (top speeds). Therefore, users can easily select an appropriate speed for the airplane to fly in limited indoor spaces or in larger outdoor areas. Additionally, the COG shifting of the present invention can be applied not only to RC and IR controlled toy models/aircrafts but may also be implemented into real aircrafts including manned and unmanned aircraft for civilian and/or military applications.

14 Claims, 11 Drawing Sheets

AIR SHIFTER TOY MODEL

CROSS REFERENCE TO RELATED APPLICATIONS

This application claims priority from U.S. Provisional Patent Application Ser. No. 61/220,228 filed on Jun. 25, 2009.

BACKGROUND

1. Technical Field

The present invention relates to flying toy models. More particularly, it relates to a flying toy model capable of shifting its center of gravity (COG).

2. Description of Related Art

Conventional outdoor flying toy models are normally designed for high speed flight. The thrust must be reduced for low speed flight, but the airplane may instantly and drastically lose its lift and consequently lose altitude and even crash. The conventional outdoor flying toy models cannot fly indoors. On the contrary, conventional indoor airplanes are designed to be lightweight and produce less thrust for low speed flight, but some levels of speed are still required to generate adequate lift to avoid stall during flight and turns. Therefore, it is generally extremely difficult for the conventional indoor airplanes to continuously fly in limited spaces. As the conventional indoor airplanes are very slow and utilize relatively low levels of thrust, they are adversely affected by even the slightest breeze. As a result, some of these indoor airplanes cannot fly outdoors at all.

SUMMARY

Unconventional and proprietary radio control (RC) or infrared remote control (IR) toy airplane which can intentionally shift center of gravity (COG) to different positions along the longitudinal centerline of the aircraft or fuselage. The incremental shifting of the COG from front to rear or vice versa incrementally changes the "angle of attack" of the wing, thereby producing a range of viable flight attitudes and resultant terminal velocities (top speeds). Therefore, users can easily select appropriate speed for the airplane to fly in limited indoor spaces or in larger outdoor areas. Additionally, this COG shifting innovation can be applied not only to RC and IR controlled toy aircraft but also to real aircraft including manned and unmanned and civilian or military applications.

In accordance with one implementation of the invention, the flying toy model having a fuselage and wing assembly includes a thrust system integrated with the fuselage/wing assembly for providing thrust to the flying toy model, and a moveable center of gravity (COG) mass positioned on the underside of the fuselage and configured to move fore and aft.

A COG shift channel is positioned on the underside of the fuselage and aligned with a longitudinal axis of the same. The COG shift channel is configured to enable the moveable COG mass to be shifted fore and aft therein.

In accordance with another implementation, the flying toy model having a fuselage and wing assembly includes a thrust system integrated with the fuselage and wing assembly for providing thrust to the flying toy model, and a COG shift channel positioned on the underside of the fuselage and aligned with a longitudinal axis of the same, and a moveable center of gravity (COG) mass positioned within the COG shift channel and configured to pivot fore and after while being supported in the COG shift channel.

Other aspects and features of the present principles will become apparent from the following detailed description considered in conjunction with the accompanying drawings. It is to be understood, however, that the drawings are designed solely for purposes of illustration and not as a definition of the limits of the present principles, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings wherein like reference numerals denote similar components throughout the views.

DETAILED DESCRIPTION

Those of skill in the art will appreciate that for conventional flying toy models, the COG is normally set up at the center of "lift" at the fuselage for optimum balance during flight. When the COG is shifted backward from the center of "lift," nose of the fuselage will tilt upward during flight. Conversely, when the COG is shifted forward, the nose tilts down. By taking advantage of this phenomenon, the nose can be intentionally tilted up or down by incorporating an adjustable proprietary COG shifting system, as set forth by the present invention.

For instance, the nose can be tilted up for indoor flight by shifting the COG rearward. The fuselage maintains an upward tilt, so the propeller(s) are also tilting upward. Now, thrust from the propeller(s) will generate more lift vs. forward speed due to tilting, but the airplane still moves forward at low speed because a sustained level of useable thrust is still being generated. In other words, the airplane can slowly move forward at a constant altitude by achieving a type of "hovering" flight, so it can even fly and maneuver in very limited indoor spaces. Adjusting throttle (propeller RPM) will allow controlled ascents and descents. The COG can be shifted forward for outdoor flight. The COG can be positioned to match the point of "lift" along the wing root at the fuselage for the fastest, most efficient horizontal flight. This attitude is the same as normal airplanes, so power of thrust can be used mostly for moving forward and attaining high speed flight. The position of the COG is infinitely adjustable from front to rear, so attitude of the fuselage (angle of attack and pitch angle) can be infinitely varied as well. The amount or direction of thrust power from propellers is adjustable, so speed can be changed from slow to fast. Users can freely select appropriate COG position for diverse environments, from small to large spaces, and for different levels of operational skill, i.e. higher levels of speed require higher levels of skill. In addition, another benefit to the shifting COG of the present principles is that by shifting the COG a tighter turning radius can be achieved, particularly at slower speeds for easier maneuvering in tighter spaces (e.g., indoor spaces). This tighter turning radius capability is achieved by shifting the COG to create a higher angle of attack, as will be explained in greater detail below.

Those of skill in the art will recognize that the shifting of the COG can be performed by radio control such that the user will have the ability to change the COG of the toy model while in use and flying. Alternatively, the shifting of the COG could be performed manually as well while the flying toy model is not in use flying.

Figure 1:
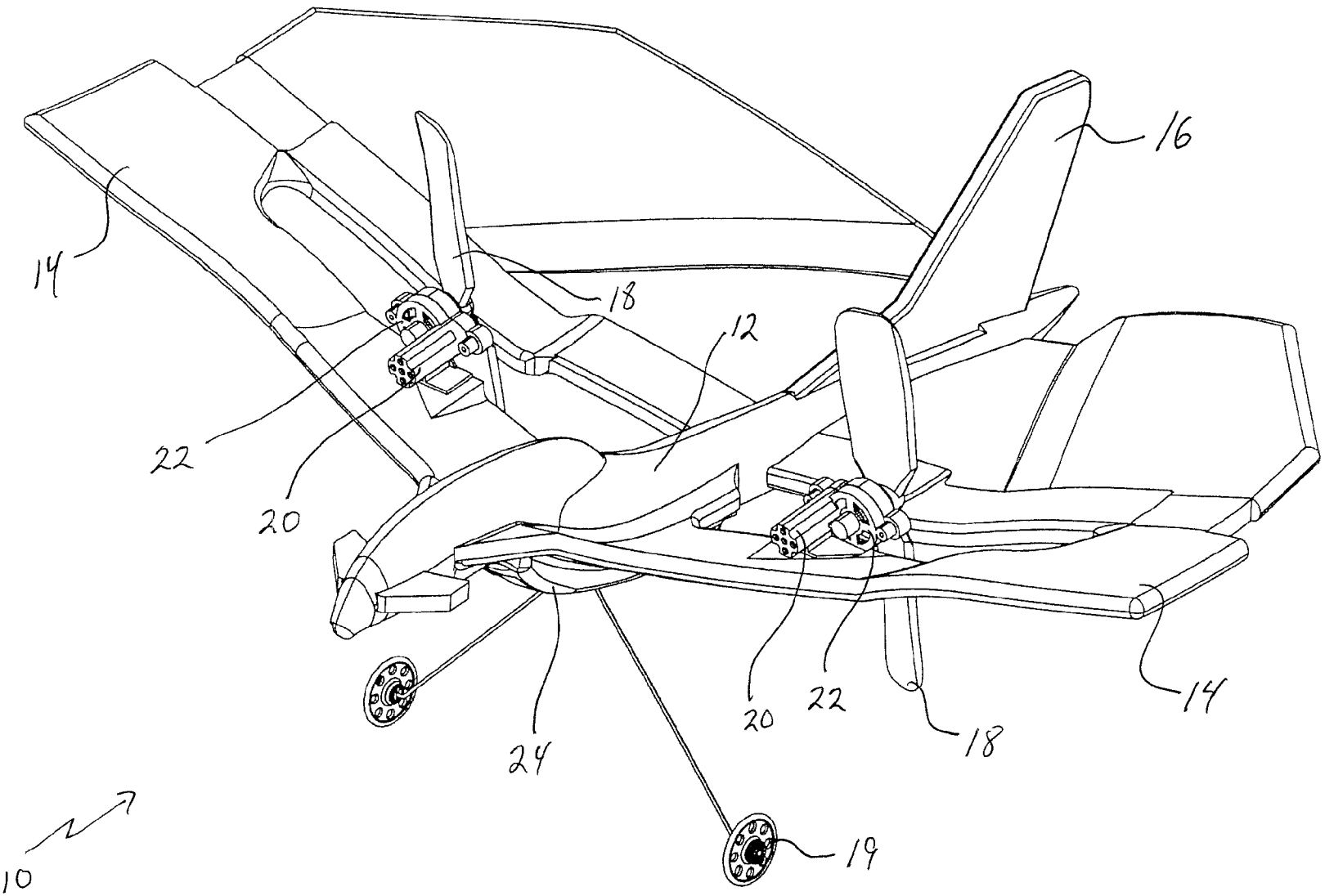
FIG. 1 is a perspective view of the toy model with shifting center of gravity (COG) according to an implementation of the invention.

Referring to FIG. 1, The flying model 10 generally consists of proprietary Fuselage/Wing Assembly 12/14, a vertical tail wing 16, Motors 20, Gears 22, Propellers 18, a COG Shift Box 24 which is configured to store RX PCB (receiver or circuit board) and is slidable within a COG shift channel 26, a battery, and landing gear 19. As used herein, the term "COG Shift box" is interchangeable with the term "COG mass". Those of skill in the art will appreciate that the "center of gravity (COG)" of any device is dependent on its design and overall distribution of the weight of the model. As such, by enabling the movement of a mass along the underside of the flying toy model, the invention proposes to "shift" the COG of the model and thereby effect increased performance and stunt capabilities not otherwise capable of being performed.

The novel configuration of the Fuselage/Wing Assembly 12/14 of the present design is to be suitable for slow flight when the nose is tilted or faces upward, and high speed flight when nose is tilted or facing downward and the model is horizontal. The innovative Fuselage/Wing Assembly 12/14 also flies well in any position in-between "hovering" type slow flight and high speed outdoor flight.

By receiving a radio control (RC) or Infrared (IR) signal from a transmitter (not shown), left and right motors 20 can rotate the propellers 18 individually at several steps or infinite steps (proportional control) and thereby can control thrust power. The rotational speed of the motors 20 can be reduced by Gear(s) 22 or a gear-train to make the propellers 18 turn efficiently.

In one implementation, the configuration of left and right propellers 18 should be symmetric, and counter rotate with respect to each other to cancel an adverse "torque steer" condition. When different rotation speed are selected for either the left or right Propeller, the fuselage 12 can turn either to left or right. If the difference of the rotation speed between left and right Propellers is larger, it will be apparent that the turning radius of the Fuselage/Wing Assembly 12/14 will be narrower. If the difference of the rotation speed between left and right Propellers is less, the turning radius of the Fuselage/Wing Assembly 12/14 will be greater.

In accordance with a preferred implementation of the present invention, the proprietary COG Shift Box 24 is slidably positioned within a COG Shift channel 26 on the underside of the fuselage 12. The COG Shift channel 26 is generally positioned with a front portion basically located at frontal area of the Fuselage/Wing Assembly 12/14 and extends rearward along the underside of the fuselage 12 toward the rear of the same. The COG shift channel 26 is configured such that the COG shift box 24 can be shifted back and forth fully to the front or rear or any infinite number of positions in between (i.e, the COG can be shifted fore and aft relative to the fuselage of the flying toy model). A balance or weight can be added inside the COG Shift Box 24, however, it is herein contemplated that the weighting of the COG shift box can be provided by incorporating a relatively heavy rechargeable battery, the receiver (RX) PCB (receiver or circuit board) and/or landing gear as ballast or weight that would be provide for efficient shifting of the COG. Through the implementation of the battery and receiver electronics into the COG shift box, the present invention provides a far better and more efficient solution than an alternative design where extraneous weight is added to the plane for COG shifting as that clearly has a negative effect and would decrease overall flight performance of the flying toy model.

Referring to FIGS. 2-7, we will discuss the variety of flight characteristics generated by the COG shifting mechanism of the present invention.

Low Speed Position

Figure 2:
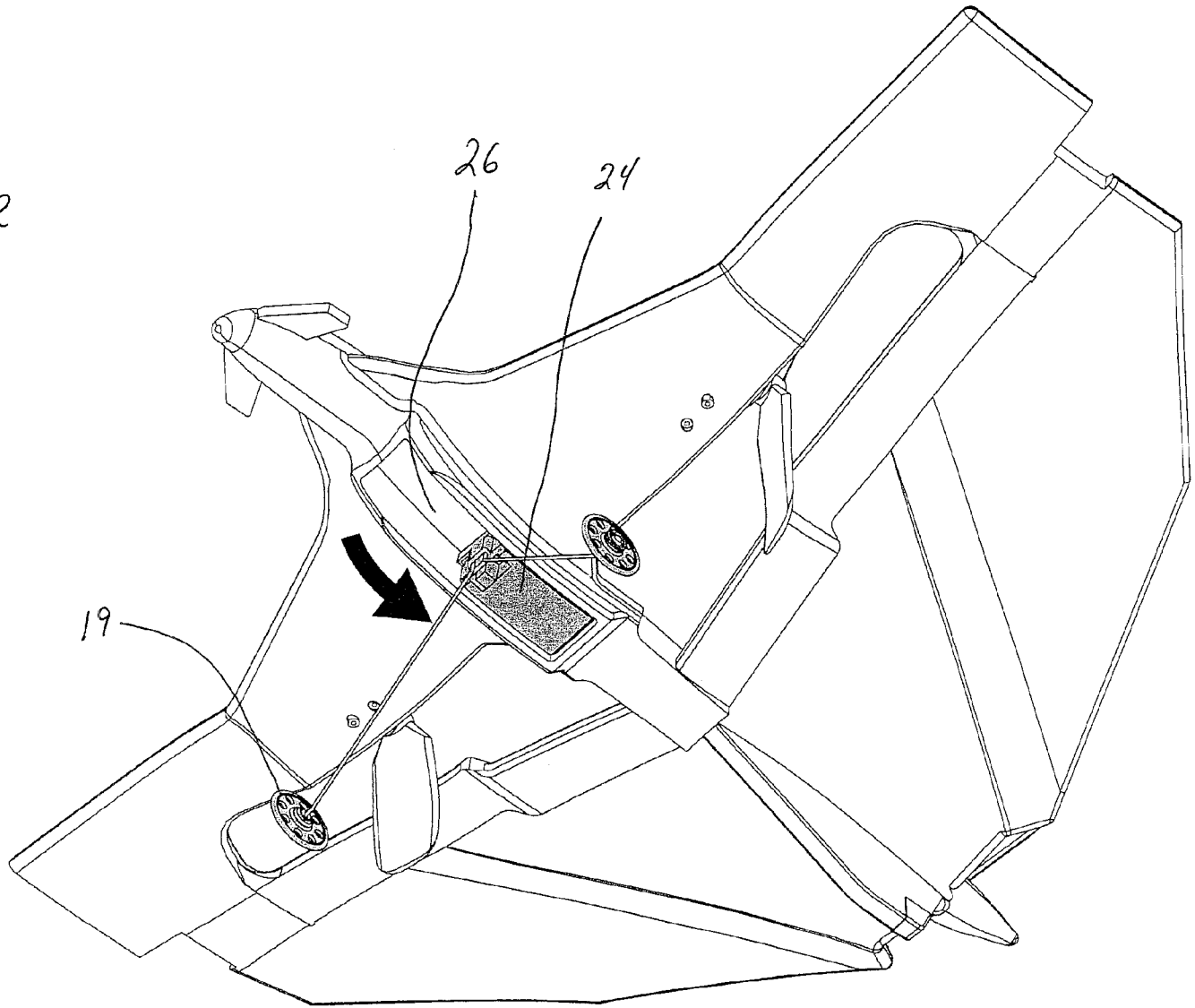
FIGS. 2-3 show an example of the toy model with shifting COG positioned for low speed operation.
Figure 3:
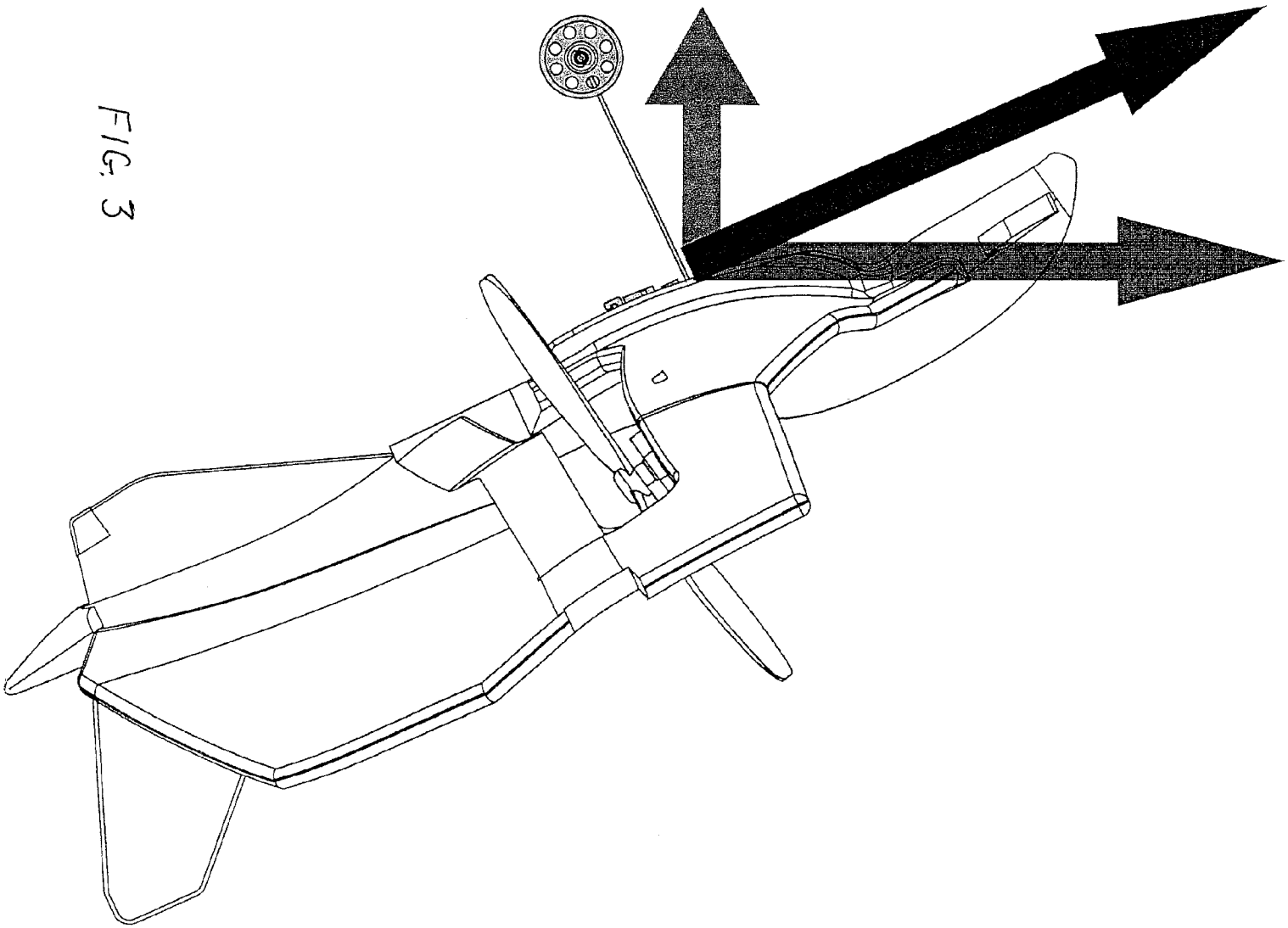

FIGS. 2 and 3 show an example of the flying model 10 of the present invention when the COG Shift Box 23 is positioned to the most rearward location within the COG shift channel 23. In this position, the nose of Fuselage/wing assembly 12/14 visibly tilts upward, so the thrust from Propellers 18 will mostly generates upward "lift," and a smaller portion of the thrust generates forward motion. With the COG shift box 23 in this position, 1) when the thrust of propellers 18 is increased, the fuselage/wing assembly 12/14 starts ascending and gains altitude; and 2) when the thrust of propellers 18 is decreased, the fuselage/wing assembly 12/14 starts descending and altitude is lost. Since the propellers 18 are tilted up by the rearward shifting of the COG shift box 24, they provide almost as much lift as they do forward thrust, so the fuselage 12 still slowly moves forward while ascending.

High Speed Position

Figure 4:
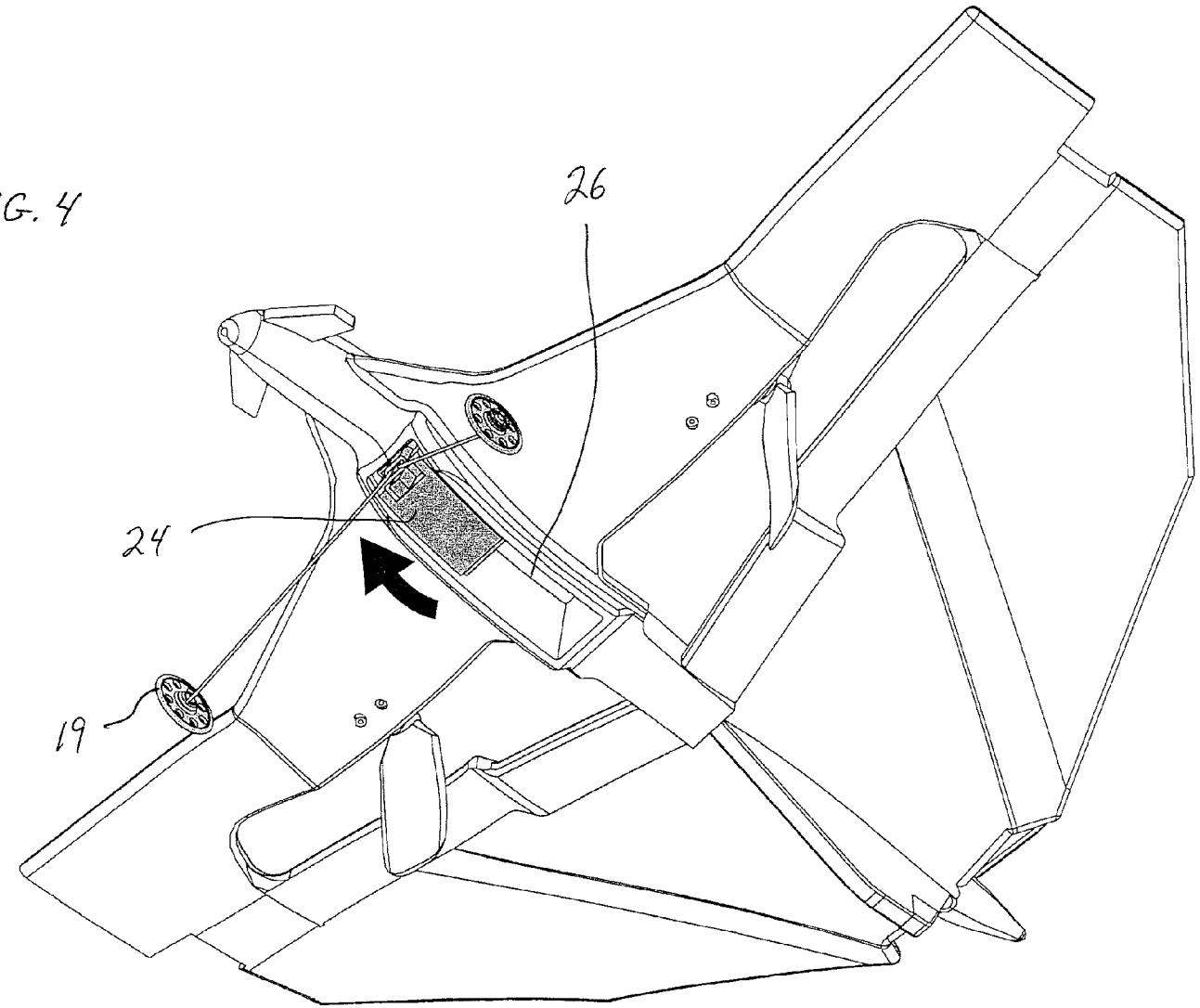
FIGS. 4-5 show an example of the toy model with shifting COG positioned for high speed operation.
Figure 5:
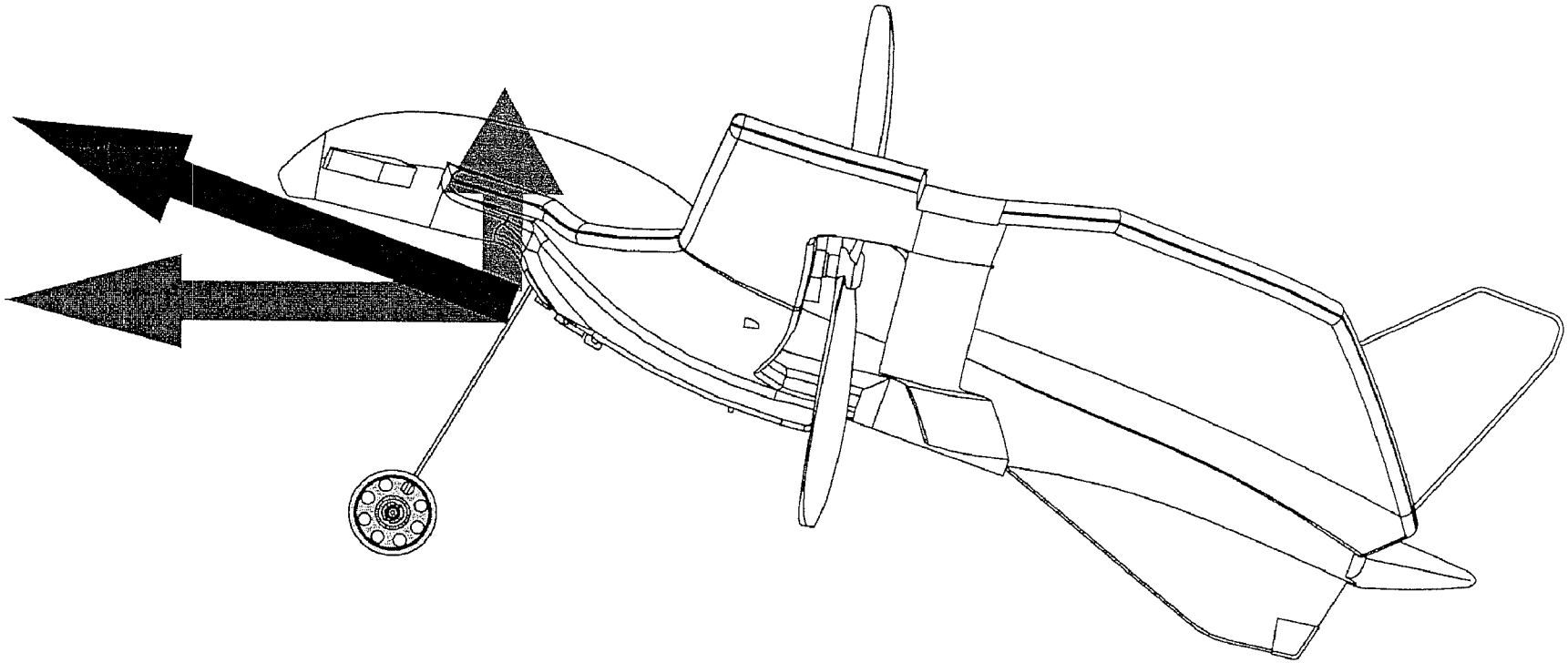

FIGS. 4 and 5 show an example of the flying model 10 of the present invention when the COG Shift Box 23 is moved to the forward most position within the COG shift box channel 26. In this position, the wing "lifting point" and the COG of the Fuselage/Wing Assembly 12/14 can be matched to each other along the longitudinal axis of the model/airplane. The nose tilts downward, and the aircraft moves forward in horizontal flight. Most of the thrust from Propellers 18 is used for forward thrust, and subsequently, high speed flight is achieved. The lift comes from the novel wing design that can fly well in various incrementally adjustable "angles of attack".

Medium Speed Position

Figure 6:
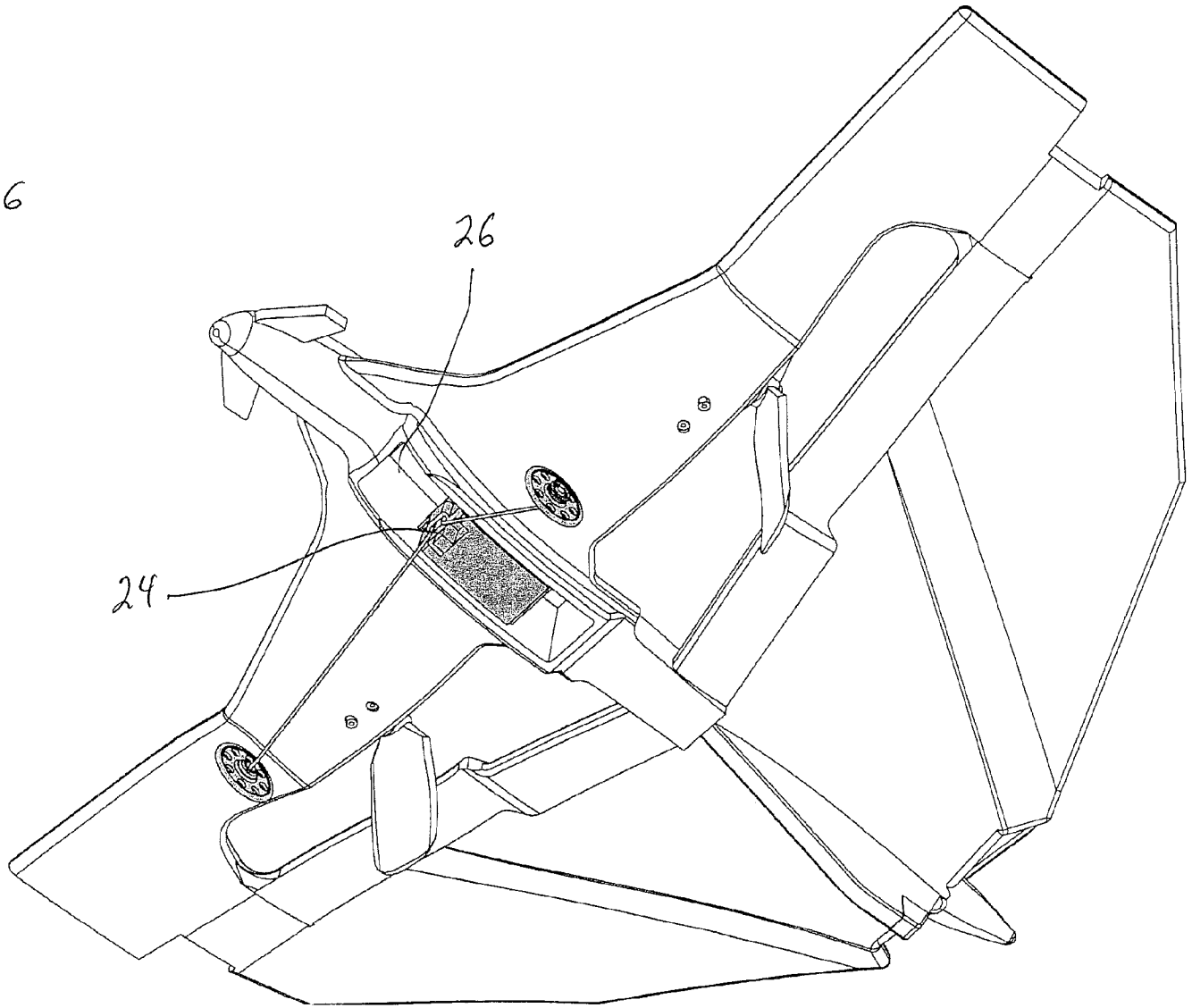
FIGS. 6-7 show an example of the toy model with shifting COG positioned for medium speed operation.
Figure 7:
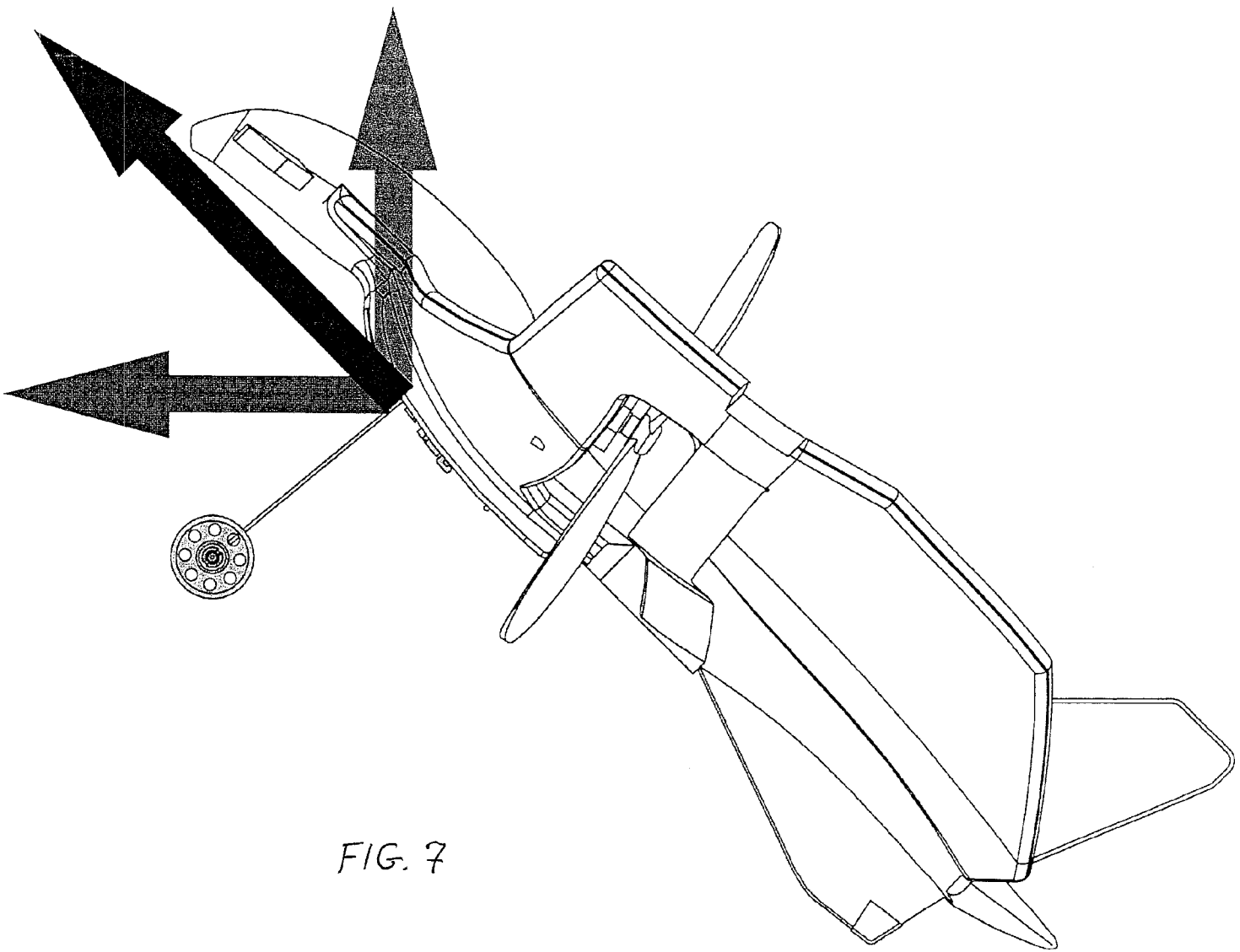

FIGS. 6 and 7 show an example of the flying model 10 of the present invention when COG Shift Box 23 is positioned at the center of the COG Shift Channel 26. In this configuration, the nose of fuselage/wing assembly 12/14 slightly tilts upward. The thrust of the propellers 18 can be allocated evenly for both lifting power and thrust to move the model forward. Again, the novel wing design of the present invention allows for flying in various tilt positions (i.e., various "angles of attack").

Selectable Takeoff Angle

Figure 8:
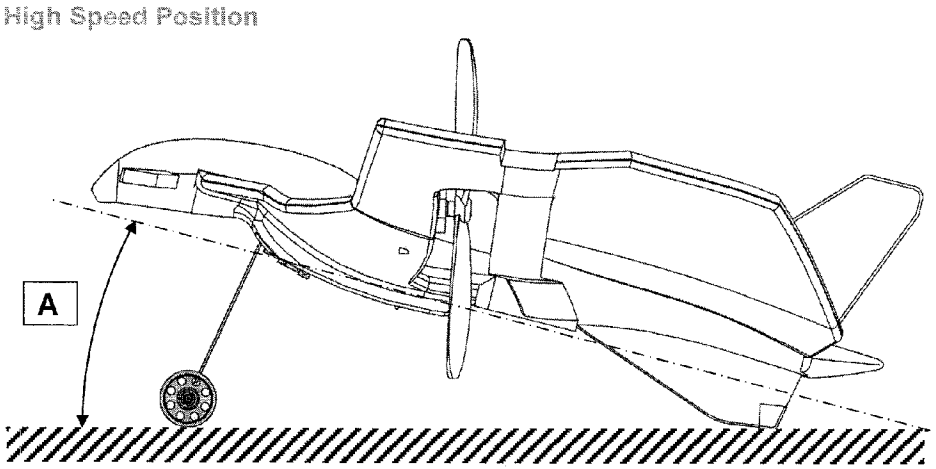
FIG. 8 shows the toy model of the present invention in an exemplary high speed position for take-off.
Figure 9:
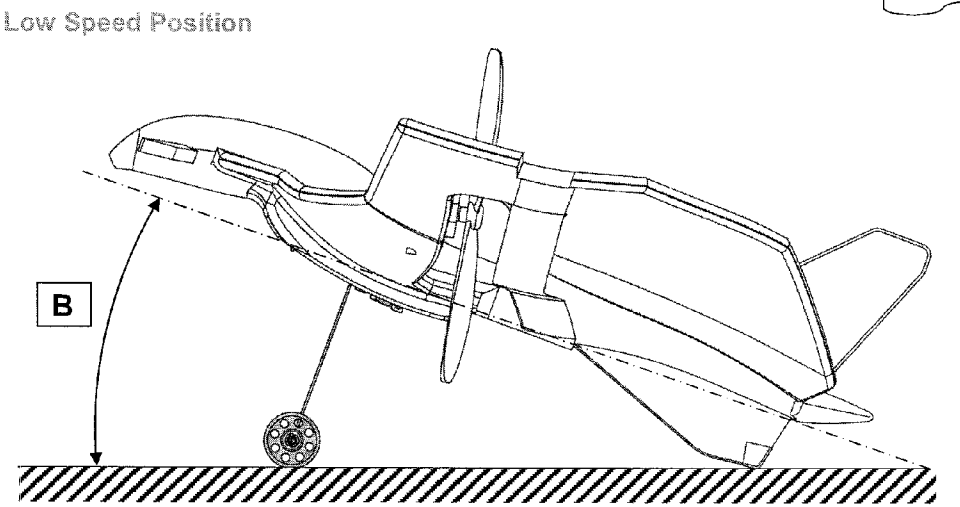
FIG. 9 shows the toy model of the present invention in an exemplary low speed position for take-off.

Referring to FIGS. 8 and 9, when taking off from the ground or floor position (i.e., without the assistance of hand launching), the nose of model 10 in Low Speed Position B (FIG. 9) faces more upward than when in the High Speed Position A (FIG. 8). The Low Speed Position B shown in FIG. 9 (and enabled by the rearward shifting of the COG Shift box 24), affords an increased angle of attack that generates more lift more quickly for faster unassisted take offs from shorter runway distances. With this implementation, the model 10 in the Low Speed Position is able to take off and get airborne over a shorter distance which presents an advantage when taking off in limited indoor space.

Those of skill in the art will appreciate that the positioning of the COG shift box 24 can be performed manually, however it is clearly understood that the COG shifting can be achieved automatically or by remote control when a separate motor or servo is implemented within the COG shifting channel 26 such that COG shifting can be achieved during flight via RC or IR signal to control the shifting servo motor.

Figure 10:
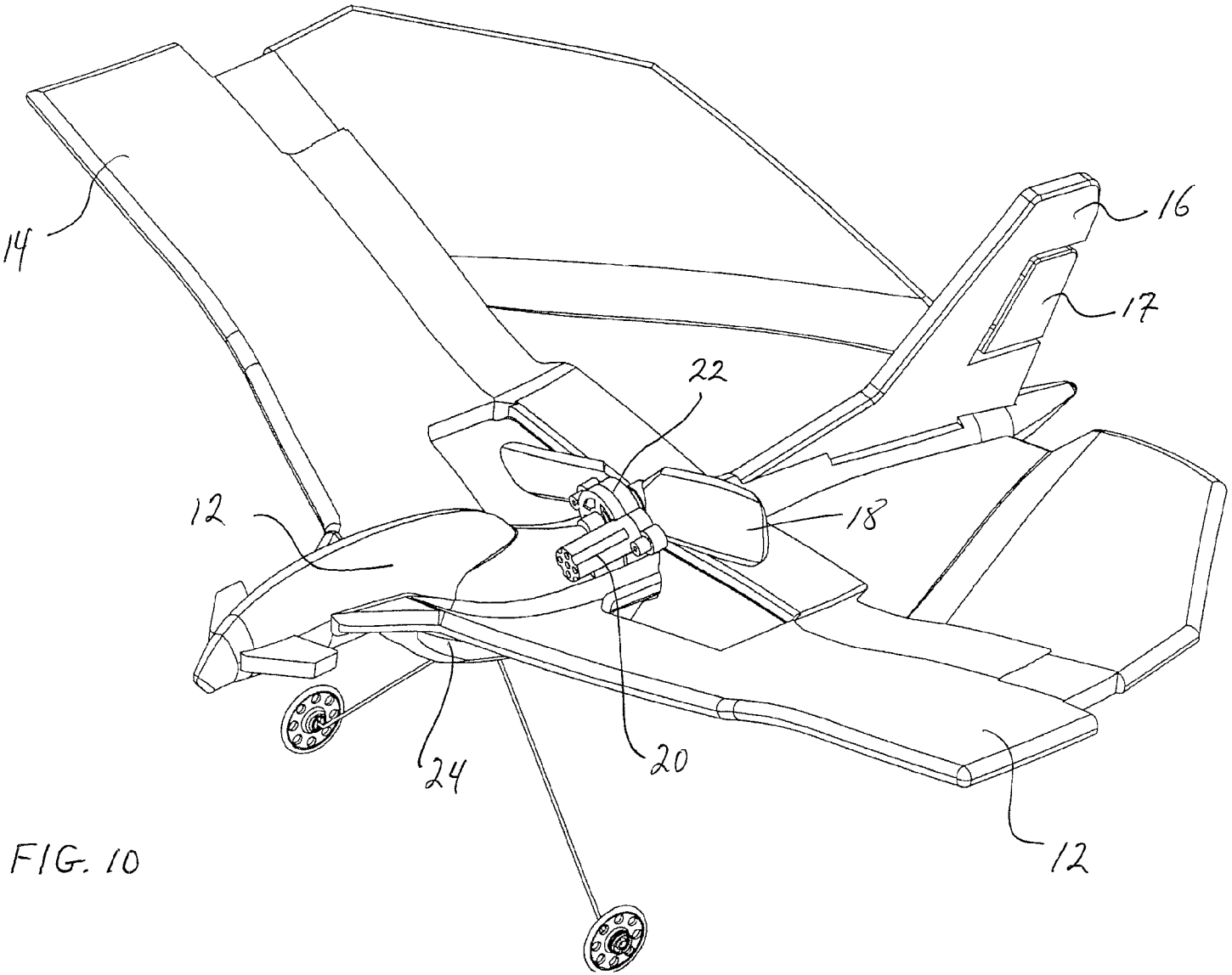
FIGS. 10-11 show the toy model with shifting COG in a single propeller implementation.
Figure 11:
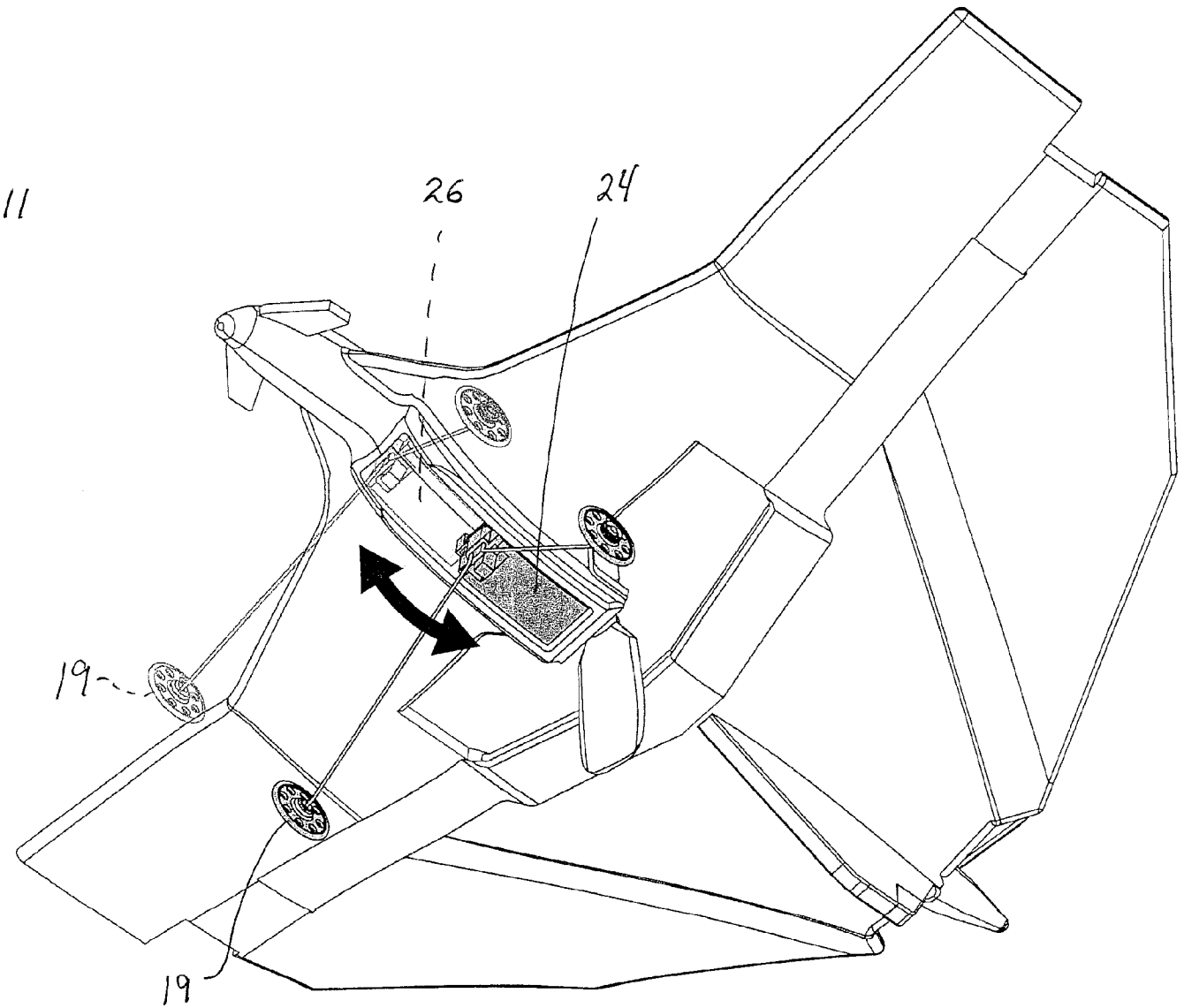

FIGS. 10 and 11 show a single propeller implementation of the flying toy model 10 according to a further implementation of the invention. In this embodiment, a rudder (or similar control surface) 17 is added to the vertical rear wing 16 to enable steering of the model during flight.

Figure 12:
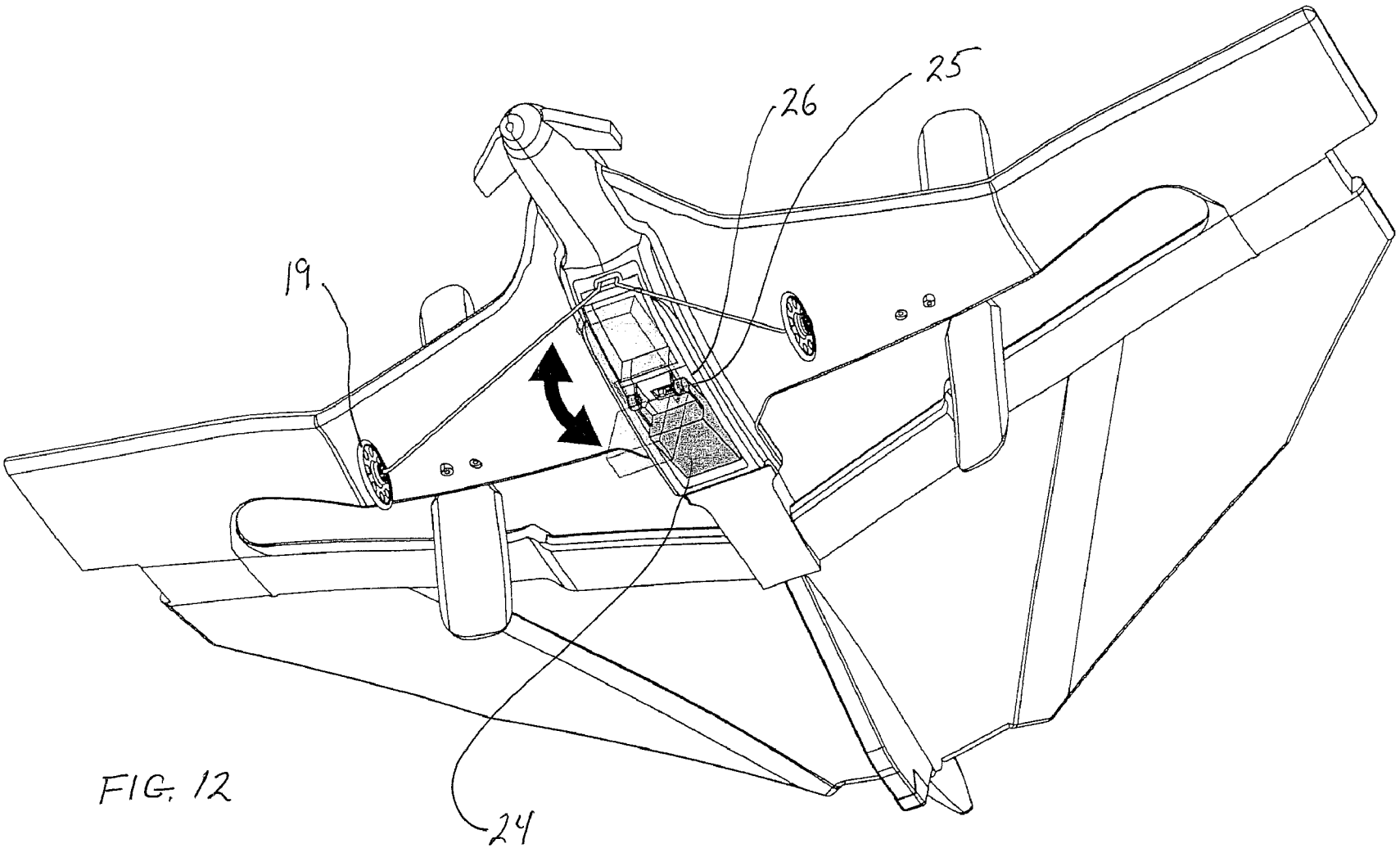
FIG. 12 is another perspective view of the toy model with shifting COG according to yet another implementation of the invention.

As described above, the shifting of COG by sliding COG Shift Box up and down within the COG shifting channel is described above, however in other contemplated implementations, the COG Shift Box can be configured as a pendulum as shown in FIG. 12. Here, the COG Shift box is pivotally mounted about a pivot point 25 such that it can swing between the forward most and rearward most positions. Thus, it will be appreciated that in this configuration, the COG shift box 24 which stores the RX PCB, battery, etc. can be pivotally moved so as to shift the position of the COG and thereby provide the additional attitude control/adjustment of the toy model of the present invention.

Finally, it is also contemplated herein that the COG can be also shifted perpendicular to the longitudinal axis of the airplane, thus causing the airplane to steer left or right depending on which side the COG is shifted to. The side to side movements can also be controlled remotely by RC or IR and can be powered by a motor. The COG can ultimately be shifted forward and rearward or side to side or a combination of the two axes of movement can be selected (i.e., control of tilting front to rear and side to side can be mixed).

While there have been shown, described and pointed out fundamental novel features of the present principles, it will be understood that various omissions, substitutions and changes in the form and details of the methods described and devices illustrated, and in their operation, may be made by those skilled in the art without departing from the spirit of the same. For example, it is expressly intended that all combinations of those elements and/or method steps which perform substantially the same function in substantially the same way to achieve the same results are within the scope of the present principles. Moreover, it should be recognized that structures and/or elements and/or method steps shown and/or described in connection with any disclosed form or implementation of the present principles may be incorporated in any other disclosed, described or suggested form or implementation as a general matter of design choice. It is the intention, therefore, to be limited only as indicated by the scope of the claims appended hereto.

What is claimed is:

1. A flying toy model having a fuselage and wing assembly, the flying toy model comprising:
- a thrust system integrated with the fuselage and wing assembly for providing thrust to the flying toy model;
- a COG shift channel positioned on the underside of the fuselage and aligned with a longitudinal axis of the same; and
- a moveable center of gravity (COG) mass disposed in the shift channel.

2. The flying toy model of claim 1, wherein the COG shift channel is configured to enable the moveable COG mass to be shifted fore and aft therein.

3. The flying toy model of claim 1, wherein said thrust system comprises:
- a propeller; and
- a motor connected to the propeller, wherein a speed of the motor is controlled by radio signals.

4. The flying toy model of claim 3, further comprising a rudder on a vertical wing at the rear of said fuselage/wing assembly.

5. The flying toy model of claim 1, wherein said thrust system comprises:
- a left wing propeller;
- a right wing propeller;
- a left motor and a right motor connected to the left and right propeller respectively, where a speed of each left and right propeller is independently controllable via radio control signals, said independent motor control enabling steering of the flying toy model.

6. The flying toy model of claim 1, wherein said COG mass further comprises radio control receiver electronics.

7. The flying toy model of claim 6, wherein said COG mass further includes a battery.

8. The flying toy model of claim 1, further comprising landing gear connected to the moveable COG mass.

9. A flying toy model having a fuselage and wing assembly, the flying toy model comprising:
- a thrust system integrated with the fuselage and wing assembly for providing thrust to the flying toy model;
- a COG shift channel positioned on the underside of the fuselage and aligned with a longitudinal axis of the same; and
- a moveable center of gravity (COG) mass positioned within the COG shift channel and configured to pivot fore and aft therein.

10. The flying toy model of claim 9, wherein said thrust system comprises:
- a propeller; and
- a motor connected to the propeller, wherein a speed of the motor is controlled by radio signals.

11. The flying toy model of claim 10, further comprising a rudder on a vertical wing at the rear of the fuselage and wing assembly.

12. The flying toy model of claim 9, wherein said thrust system comprises:
- a left wing propeller;
- a right wing propeller;
- a left motor and a right motor connected to the left and right propeller respectively, where a speed of each left and right propeller is independently controllable via radio control signals, said independent motor control enabling steering of the flying toy model.

13. The flying toy model of claim 9, wherein said COG mass contains radio control receiver electronics.

14. The flying toy model of claim 13, wherein said COG mass further contains a battery.

* * * * *